US005291630A

United States Patent [19]

Brown

[11] Patent Number: 5,291,630

[45] Date of Patent: Mar. 8, 1994

[54] DAMPER AND METHOD OF CONTROLLING A DOOR

[75] Inventor: Peter E. Brown, Bridgnorth, United Kingdom

[73] Assignee: Jebron Limited, Wednesbury, United Kingdom

[21] Appl. No.: 978,898

[22] Filed: Nov. 19, 1992

[30] Foreign Application Priority Data

Nov. 28, 1991 [GB] United Kingdom ..... 9125321

[51] Int. Cl.[5] ..... E05F 3/10; E05F 3/22

[52] U.S. Cl. ..... 16/53; 16/56

[58] Field of Search ..... 16/53, 55, 56, 57, 58

[56] References Cited

U.S. PATENT DOCUMENTS 3,210,796 10/1965 Voester et al. ..... 16/55
3,259,937 7/1966 Kotikov ..... 16/58

FOREIGN PATENT DOCUMENTS 510662 8/1939 United Kingdom .
522775 6/1940 United Kingdom .
801803 9/1958 United Kingdom .

*Primary Examiner*—Lowell A. Larson
*Assistant Examiner*—Carmine Cuda
*Attorney, Agent, or Firm*—Webb Burden Ziesenheim & Webb

[57] ABSTRACT

A door closer comprises a housing containing a cylinder and two movable pistons. When the associated door is opened, both of the pistons and the cylinder are moved relative to the housing to draw oil into the cylinder. Expulsion of oil from the cylinder through an orifice on closing of the door controls the closing movement.

18 Claims, 5 Drawing Sheets

DAMPER AND METHOD OF CONTROLLING A DOOR

BACKGROUND TO THE INVENTION

From one aspect, the present invention relates to the use of a damper for controlling the swinging of a pivoted door. There are known dampers which are used for controlling the swinging of a door and which comprise a cam and follower mechanism, the cam being connected with the door to turn with the door and the follower being urged by a spring towards the cam so that the spring is compressed when the door is opened and the spring urges the door to swing towards the closed position. The damper restricts the speed of closing.

A damper which is suitable for controlling the swinging of a door in either of two opposite directions from a closed position is disclosed in United Kingdom specification 852213 published Oct. 26th 1960. The damper disclosed in this specification comprises a housing within a body is guided for reciprocation relative to the housing. Springs urge the body in one direction relative to the housing. A pair of cylindrical chambers are formed in the body, these chambers having respective axes which are inclined to each other and to the direction of reciprocation of the body. Each chamber contains a piston carrying a respective follower which bears on a common cam. The cam is rotatable relative to the housing with an operating member of the damper. Damping action is achieved by restricting the rate at which oil can escape from one of the cylindrical chambers through a respective orifice. The volume of the chambers is small, as compared with that of the housing.

For closing and holding closed large and heavy doors, there is a requirement for a door closer having a strong spring. There is also a requirement to restrict the overall dimensions of the door closer. It is possible to provide a strong spring in a housing of acceptable size. However, it is more difficult to provide an adequate damping action in a door closer having a cam and follower mechanism and a strong spring, if the throw of the cam is restricted by the overall dimensions of the door closer. Typically, the throw of the cam of a door closer having acceptable overall dimensions cannot be more than about 20 mm. To compensate for the limited throw of the cam, it has been proposed to amplify the movement by means of a lever and apply the amplified movement to the damper. An example of a damper incorporating a lever is disclosed in United Kingdom specification 905686 published Sep. 12th 1962. However, this arrangement is not entirely satisfactory. The present invention provides an alternative damper arrangement which is more satisfactory than is the use of a lever.

SUMMARY OF THE INVENTION

According to a first aspect of the invention, there is provided a damper comprising a housing, an operating member mounted for movement relative to the housing, a cylinder mounted in the housing for reciprocation relative thereto, a piston movable in the cylinder in a direction parallel to the direction of reciprocation of the cylinder and drive means for transmitting motion between the operating member and the cylinder and transmitting motion between the operating member and the piston to move both the cylinder and the piston relative to the housing and relative to each other when the operating member is moved relative to the housing and is then returned to its initial position.

By moving both the cylinder and the piston, the volume of fluid displaced is increased, relative to that which is displaced if only one of the piston and the cylinder is moved and a better damping action can be achieved.

The preferred damper incorporates a plurality of pistons and relative movement of the cylinder and each piston contributes further to the displacement of fluid and therefore to the damping action. The preferred damper comprises first and second guide means adjacent to respective end portions of the cylinder for guiding the cylinder for reciprocation relative to the housing. The guide means adjacent to the drive means preferably comprises a pair of outer guide elements incorporated in the housing and a pair of inner guide elements incorporated in the cylinder and lying between the outer guide elements. The guide elements of one of these pairs may be rollers.

The inner guide elements may also guide a piston rod of a first piston, this piston rod extending between the inner guide elements to the drive means.

The second guide means preferably slides inside the cylinder.

The damper may further comprise a main spring which drives the cylinder in one direction relative to the housing. The cylinder preferably lies inside the main spring. It will be understood that disposing the cylinder inside the main spring facilitates the provision of a relatively short damper, as compared with the overall length which would be required if the cylinder and the main spring are arranged end-to-end. In the preferred damper, the volume of fluid displaced by movement of the cylinder and of a plurality of pistons within the cylinder is sufficient to ensure a good damping action, even when the diameter of the cylinder is sufficiently small for the cylinder to be received in the main spring.

The outer guide elements may be adjustable relative to the housing in a direction transverse to the direction of reciprocation of the cylinder for adjusting the path along which the cylinder reciprocates and thereby adjusting the position to which the operating member is urged.

The drive means preferably includes a cam and follower mechanism, the cam being mounted in the housing for turning relative thereto about a cam axis which is transverse to the direction of reciprocation of the piston and the cylinder.

In the preferred damper, there is provided a pair of transmission elements which occupy respective positions which are fixed with respect to the cylinder or with respect to at least one of the pistons, the transmission elements being spaced apart in a direction transverse to the cam axis and transverse to the direction of reciprocation of the cylinder, and the follower being trapped between the cam and the transmission elements but being free to undergo limited movement relative to those elements. The follower is thus able to remain in firm engagement with both of the transmission elements, even if components of the damper are subjected to wear during the service life of the damper.

It is a common problem with known dampers used for controlling the swinging of a pivoted door that variations in the dimensions of components within accepted tolerance limits and wear of components during the service life of a damper give rise to situations in which the door can be turned through a few degrees without compression of a spring incorporated in the damper taking place. Such movement is not opposed by the damper. The door is free to move through a small angle and the damper does not set the door in a predetermined position with sufficient accuracy. This is a particular problem in a case where the door is required to constitute a fire barrier.

According to a second aspect of the invention, there is provided a method of controlling the swinging of a pivoted door wherein there is connected with the door a rotary member supported in a housing for turning with the door, upon swinging of the door from a rest position, a piston and a cylinder are moved in opposite directions to draw liquid into the cylinder and, during return of the door to the rest position, the movement of both the piston and the cylinder is reversed, expelling liquid from the cylinder through an orifice.

BRIEF DESCRIPTION OF THE DRAWINGS

An example of a door closer incorporating a damper according to the invention will now be described, with reference to the accompanying drawings, wherein.

DESCRIPTION OF PREFERRED EMBODIMENT

Figure 1:
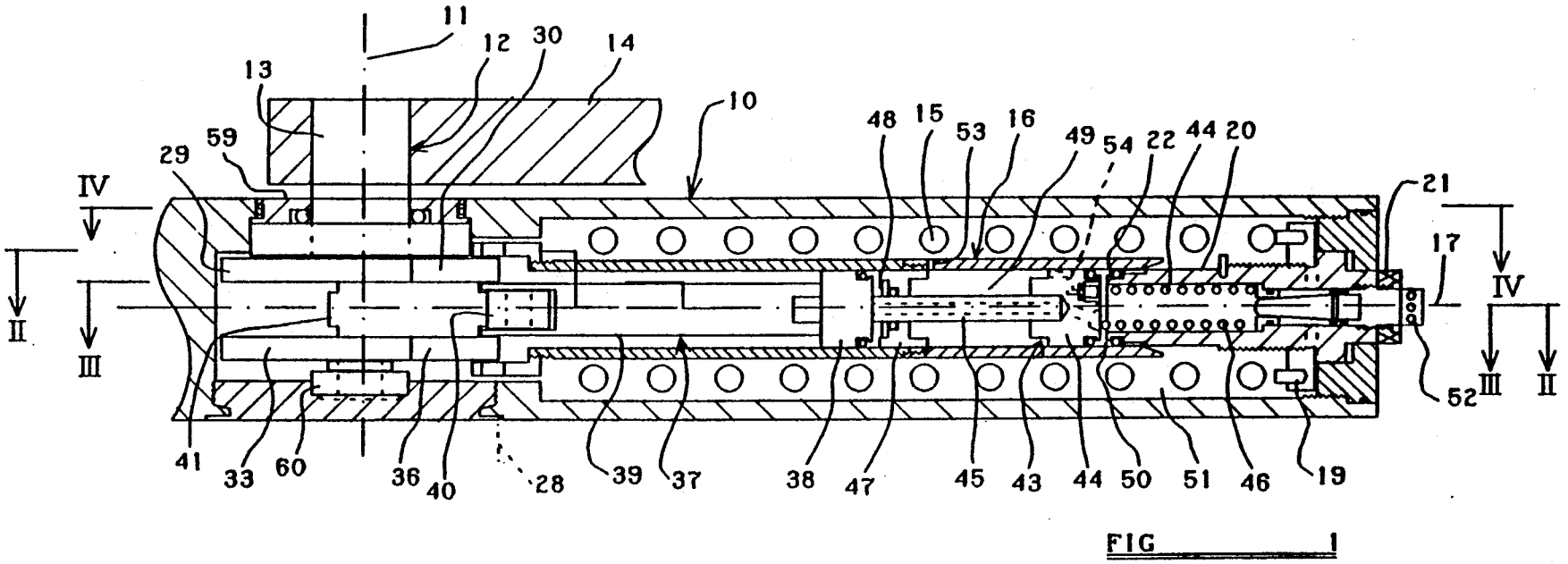
FIG. 1 shows a cross section through the door closer in a vertical plane and with an operating member of the door closer in a rest position.

The device illustrated in the accompanying drawings comprises a hollow housing 10 in which there is mounted by bearings 59, 60 for turning about an axis 11 a rotary member 12. An end portion 13 of the member 12 protrudes at the outside of the housing 10 and receives an arm 14, by means of which the rotary member 12 is connected with a door for turning with the door relative to the housing 10. Typically, the housing 10 is embedded in a floor and the door is supported for pivoting at the axis 11. The arm 14 may be attached to the bottom of the door and is typically received in a recess formed in the door. The end portion 13 is non-circular and is received in a complementary opening in the arm at one end thereof.

There is disposed inside the housing 10 a coiled compression spring 15 and a drive mechanism for transmitting motion between the spring and the rotary member 12. The drive mechanism is arranged to compress the spring 15 when the door and member 12 are turned from a rest position. The spring then urges the door and member 12 towards the rest position.

The device illustrated in the drawings is constructed to act as a damper and damp movement of the door towards the rest position under the action of the spring. It will be appreciated that, without the damping action, the door would be accelerated by the spring throughout movement towards the rest position, which would be unacceptably dangerous. In a case where the door is free to swing in either direction from the rest position, damping also enables the door to be brought to rest, when it reaches the rest position, rather than to pass through the rest position and then to oscillate about the rest position.

A cylinder 16 is mounted inside the housing 10 for reciprocation relative thereto along an axis 17 of the cylinder. The axis 17 extends centrally along the length of the housing 10 and either intersects the axis 11 or passes near to that axis. The cylinder 16 has at one end an enlarged, hollow head 18, on which there is formed a seat for one end of the spring 15. That part of the cylinder 16 other than the head 18 lies inside the spring 15. The spring extends beyond the cylinder 16 to a further seat 19, on which an end of the spring remote from the head 18 bears. The cylinder is open at both of its ends.

The seat 19 is mounted on a carrier 20 which is supported in one end portion of the housing 10 against movement outwards of the housing. The carrier 20 can turn relative to the housing about the axis 17 and a non-circular end portion 21 of the carrier protrudes from the end of the housing to facilitate turning of the carrier by means of a suitable tool. The seat 19 is annular and has a female screw thread cooperating with a male screw thread on the carrier 20. The seat 19 is restrained against turning relative to the housing by the spring 15. This may be achieved by friction between the spring and the seat. Additionally, there may be formed on the seat 19 an axially projecting lug which cooperates with the spring to prevent turning of the seat relative to the spring. Accordingly, by turning of the carrier 20 relative to the housing 10, the seat 19 can be screwed along the housing to increase or decrease the stress in the spring 15.

The carrier 20 is integral with a hollow piston 22 over which the cylinder 16 slides. The piston has an annular seal for bearing on the wall of the cylinder to establish an oil-tight relation between the piston and the cylinder. The piston 22 serves to guide the adjacent end portion of the cylinder 16 for movement relative to the housing along the axis 17.

Figure 3:
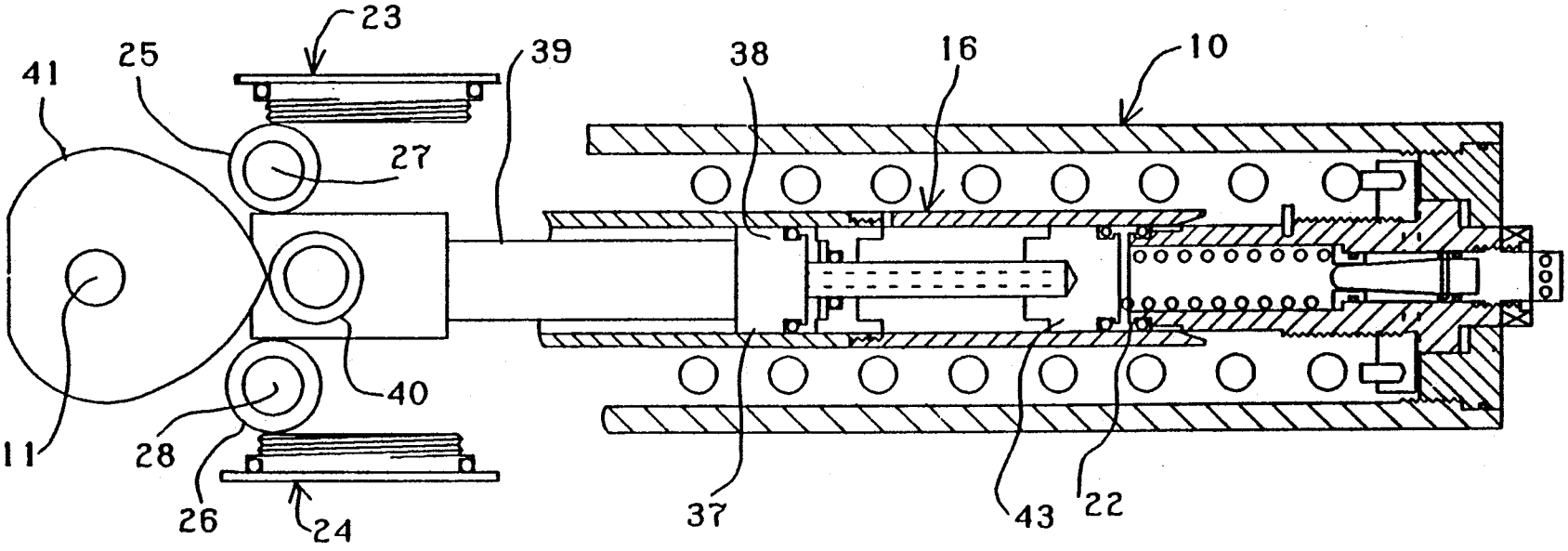
FIG. 3 is a representation similar to that of FIG. 2 of a cross section on the line III—III of FIG. 1.

Further guide means is provided for guiding the head 18 for movement along the axis 17 relative to the housing 10. The further guide means is represented in FIG. 3 and comprises a pair of outer guide elements 23 and 24 incorporated in the housing 10 and a pair of inner guide elements 25 and 26 incorporated in the head 18 of the cylinder. The inner guide elements are formed as rollers and are mounted for free rotation relative to the head 18 about respective axes 27 and 28 which lie on opposite sides of the axis 17, are equally spaced from that axis and are perpendicular to that axis. The roller axes 27 and 28 are parallel to the axis 11. The outer guide elements 23 and 24 have respective flat, mutually parallel faces on which the rollers 25 and 26 run.

A first cam 29 lies inside the housing 10, adjacent to the cylinder head 18, and is fixed with respect to the rotary operating member 12. The cylinder 16 is provided with a cam follower for cooperating with the cam 29. In the example illustrated, the cam follower is a roller 30 which engages the periphery of the cam 29. For transmitting force between the head 18 of the cylinder and the roller 30, there is provided a pair of rollers 31 and 32 mounted for free rotation relative to the head 18 about the axes 27 and 28. Thus, the axes of the rollers 31 and 32 are fixed with respect to the cylinder 16. The roller 30 is, however, free to undergo limited movement relative to the cylinder, although the roller 30 is trapped in the head 18.

The cylinder 16 is urged towards the axis 11 by the main spring 15. Accordingly, the rollers 31 and 32 are held in firm engagement with the cam follower roller 30 and the latter roller is held in firm engagement with the first cam 29. This relationship is achieved, irrespective of manufacturing tolerances and irrespective of normal wear of components which may occur during the service life of the device.

A second cam 33, which is identical with the cam 29, is mounted in fixed relation to, but spaced along the axis 11 from, the first cam 29. The cylinder head 18 is provided with a further pair of rollers corresponding to the rollers 31 and 32 and mounted for rotation relative to the head about the axes 27 and 28 and with a further floating roller 36 corresponding to the floating roller 30, the roller 36 cooperating with the second cam and with the further pair of rollers in the same manner as that in which the floating roller 30 cooperates with the first cam and with the rollers 31 and 32.

A movable piston 37 is mounted inside the cylinder 16 for reciprocation relative thereto along the axis 17. The piston 37 comprises a head 38 bearing a peripheral seal which cooperates with the wall of the cylinder and a piston rod 39 extending from the head 38 in a direction towards the axis 11. The piston rod 39 passes between the guide rollers 25 and 26 and is thereby guided for movement along the axis 17. At its end remote from the head 38, the piston rod 39 carries a cam follower in the form of a roller 40. The roller 40 bears on the periphery of a cam 41 interposed between the cams 29 and 33 and fixed with respect thereto.

A third piston 43 is also mounted in the cylinder 16 for reciprocation relative thereto. The third piston comprises a head 44 bearing a peripheral seal which cooperates with the wall of the cylinder and a piston rod 45 which extends from the head 44 in a direction towards the piston 37 and the axis 11. A coiled compression spring 46, which lies mainly inside the hollow piston 22 and which protrudes therefrom to the head 44 of the piston 43 urges the piston 43 towards the piston 37 and thereby urges the piston 37 towards the axis 11. This maintains the roller 40 in engagement with the periphery of the cam 41.

The cylinder 16 contains an annular plug 47 which lies between the piston head 38 and the piston head 44. This plug is fixed with respect to the cylinder and is sealed to the cylinder. For convenience of manufacture and assembly of components of the device, the cylinder may be formed in two parts, which meet at the plug 47. The plug may be employed to connect these parts of the cylinder together. The piston rod 45 extends through the plug 47 and is sealed with respect thereto by an annular seal mounted in the plug. The plug divides a first chamber 48 in the cylinder 16, lying between the piston head 38 and the plug, from a second chamber 49 lying between the plug and the piston head 44. A third chamber 50 inside the cylinder extends from the piston head 44 to the fixed piston 22 and includes the interior of that piston. Passages are provided for the flow of oil between these chambers and the space 51 outside the cylinder 16 which contains the main spring 15.

A passage providing communication between the third chamber 50 and the space 51 contains an adjustable needle valve 52. The needle valve is screwed into a threaded bore formed in the carrier 20 and a portion of the valve protrudes at the outside of the carrier 20, so that a tool can be applied to the needle valve to adjust the degree of constriction of the flow path past the needle valve. The needle valve extends into an annular restrictor disposed in the central bore of the carrier 20. Lateral ports extend from this central bore to the space 51 at a position between the restrictor and the adjacent end of the housing 10.

A port 53 is formed in the cylinder 16 at a position between the plug 47 and the piston head 44. This port provides for relatively free flow of oil between the space 51 and the second chamber 49. A filter may be provided in the port 53 to prevent solid matter entering the cylinder. Communication between the second chamber 49 and the third chamber 50 is provided by a passage 54 formed in the piston head 44. This passage contains a non-return valve which permits flow in a direction from the second chamber to the third chamber but prevents flow through the passage 54 from the third chamber to the second chamber.

The third chamber 50 is in communication with the first chamber 48 via passages formed in the piston head 44 and the piston rod 45, which is hollow along its entire length. A recess is formed in that face of the piston head 38 which abuts the piston rod 45, to ensure free flow between the interior of the piston rod 45 and the first chamber 48.

During manufacture of the device, the housing 10, including the interior of the cylinder 16 and all other hollow components, is charged with oil.

Figure 2:
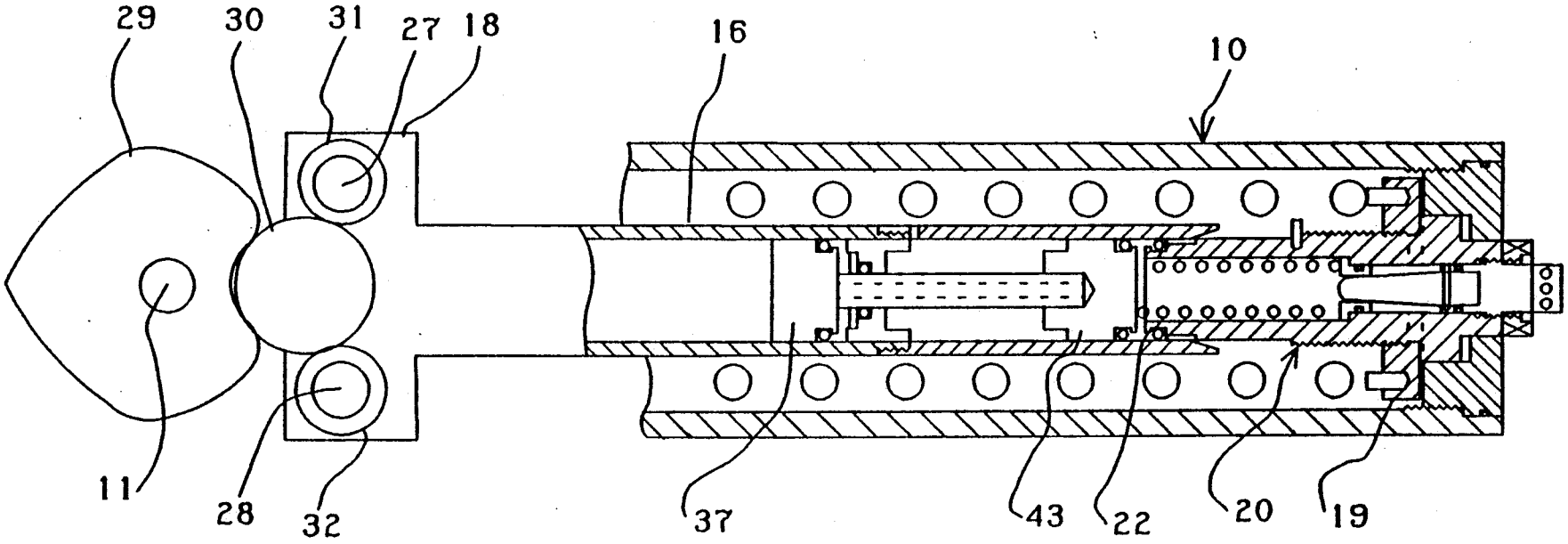
FIG. 2 is a diagrammatic representation of a cross section through the door closer along the stepped line II—II indicated in FIG. 1.
Figure 4:
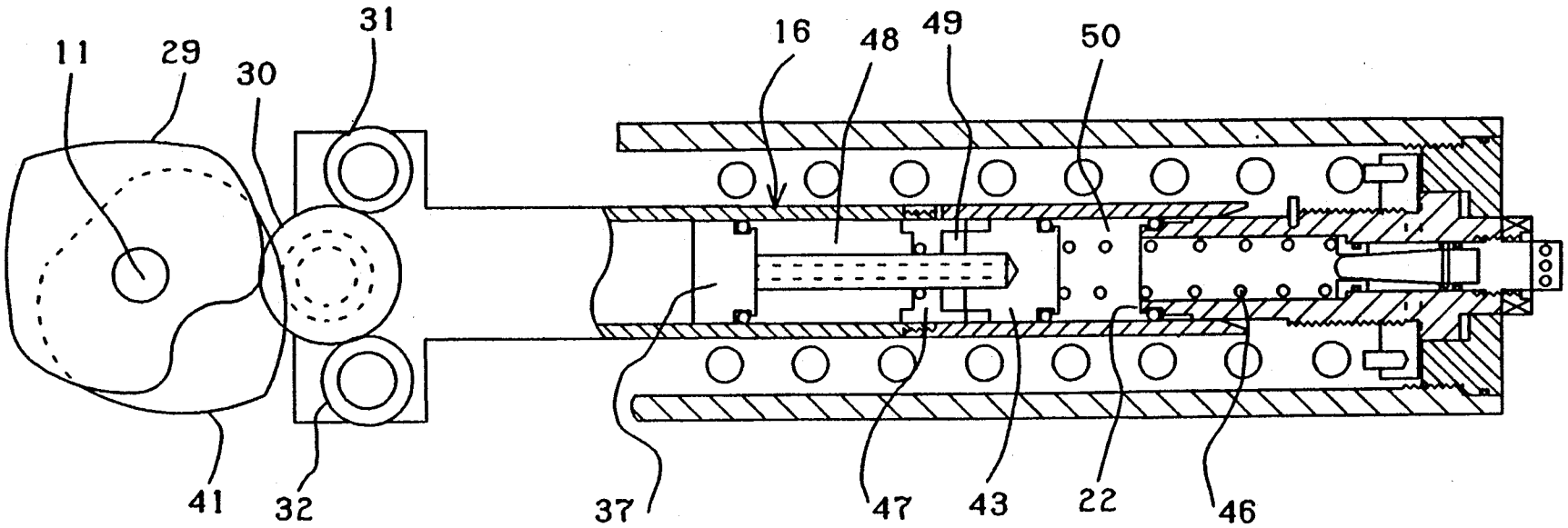
FIG. 4 is a diagram similar to FIG. 2 but illustrating parts of the door closer in positions occupied when the operating member is out of the rest position.
Figure 5:
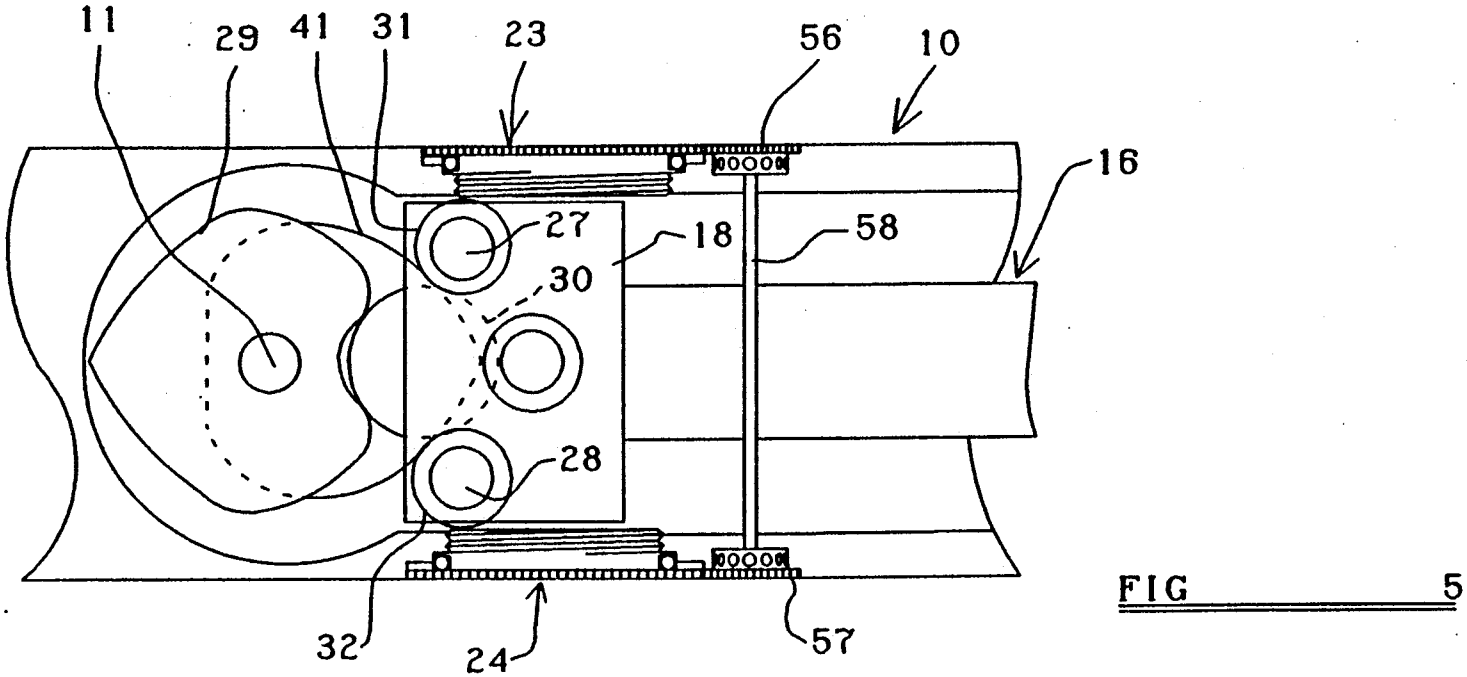
FIG. 5 illustrates diagrammatically certain parts of the door closer, as viewed in cross section in the plane V—V of FIG. 1.

FIG. 2 illustrates the positions of the first cam 29, cylinder 16 and the pistons 22, 37 and 43, when the rotary operating member 12 is in a rest position relative to the housing 10. This is the position occupied when the main spring 15 is extended. It corresponds to the closed position of a door connected with the operating member 12. FIG. 3 illustrates the positions of the cam 41, guide rollers 25 and 26, the cylinder and the pistons also when the operating member 12 is in the rest position. When the operating member is turned from the rest position, the cam 29 drives the floating roller 30 away from the axis 11, a small, initial, angular movement of the cam causing a relatively large displacement of the roller. Since the rollers 31 and 32 are held in firm engagement with the floating roller 30 and have respective axes which are fixed with respect to the cylinder 16, the cylinder is caused to move away from the axis 11 with the floating roller 30. The positions occupied when the cam has been turned through an angle of 60° from the rest position are illustrated in FIG. 4. It will be noted that turning of the cam from the rest position causes the cylinder 16 to slide along the fixed piston 22. FIG. 4 also shows the positions of the roller 40 and the piston 37 when the cam 41 has turned 60° from the rest position. It will be seen that this movement of the cam permits the roller 40 to approach the axis 11. The spring 46 causes the pistons 37 and 43 to move with the roller 40 so that the pistons move relative to the housing 10 in a direction opposite to that in which the cylinder 16 moves relative to the housing. Accordingly, the piston head 38 moves away from the plug 47 through a distance equal to the combined strokes of the cylinder and the pistons. The first chamber 48 is therefore enlarged considerably. The volume of the third chamber 50 also is increased, although by a smaller amount, as the piston 43 moves away from the fixed piston 22. As the volumes of the chambers are increased, oil flows from the space 51 through the port 53 and the passage 54 to the third chamber and from there through the hollow piston rod 45 to the first chamber.

Turning of the cam 29 from the rest position moves the cylinder 16 in a direction to compress the main spring 15. When the associated door is released, the spring 15 drives the cylinder 16 towards the axis 11. The cam and follower mechanism transmits motion from the cylinder 16 to the operating member 12 so that the door is swung towards the rest position. Turning of the operating member towards the rest position is yieldably opposed by the damping action of the device.

As the cam 41 is turned towards the rest position, it drives the roller 40 away from the axis 11. The piston head 38 is moved towards the plug 47 so that the volume of the first chamber 48 is reduced. Oil is expelled from that chamber along the interior of the hollow piston rod 45 to the third chamber 50. The piston 43 also is moved away from the axis 11 towards the fixed piston 22 so that the volume of the third chamber 50 also is reduced. Flow of oil from the third chamber to the second chamber 49 is prevented by the non-return valve in the passage 54. Accordingly, all of the oil expelled from the first chamber 48 and from the third chamber 50 must flow through the orifice restricted by the needle valve 52. Closing movement of the door is thereby controlled.

The shape of the cam 29 is selected to provide that the action of the floating roller 30 on the cam, when the operating member 12 is in the rest position, is a strong centering action, driving the cam to and holding the cam i the rest position. The orientation of the cam relative to the housing 10, when in the rest position, can be adjusted through a small range by adjusting the outer guide elements 23 and 24 in a direction transverse to the axis 11.

The cams 29 and 33 can be turned from the rest position in either direction beyond 90° towards 180°. The external dimensions of the housing 10 can be sufficiently small for the housing to be incorporated in a transom above a door. In some cases, the size of the housing, relative to that of the door, may be such that the housing can be incorporated in the door.

Each of the outer guide elements 23 and 24 is formed with a male screw thread and is screwed into a threaded opening in the housing 10. The guide elements are screwed towards each other until they are in firm engagement with respective ones of the guide rollers 25 and 26. The outer guide elements may be set in positions such that the axis 17 intersects the axis 11. Alternatively, both guide elements may be moved in the same direction relative to the housing to shift the axis 17 to one side of the axis 11 and thereby adjust the rest position of the operating member 12. To facilitate adjustment, each of the outer guide elements may be adapted to receive a tool. For example, a slot may be formed in the face of the guide element which is exposed at the outside of the housing 10. However, in the example illustrated in the drawings, transmission means is provided for transmitting rotary drive to both of the outer drive elements concurrently. The transmission means includes a sprocket 56 mounted in the body adjacent to the guide element 23 and having teeth meshing with teeth formed at the periphery of the guide element. A corresponding sprocket 57 is mounted in the body adjacent to the guide element 24. Each of the sprockets includes a hub in which there are formed a number of radial bores for receiving a bar or other tool, by means of which the sprocket can be turned relative to the housing. There is in the housing an opening which permits access to a part of the hub of each sprocket. The sprockets 56 and 57 have a common axis and are connected together by a shaft 58 which extends across the housing 10. The sprockets are fixed on opposite end portions of the shaft 58 so that the sprockets are constrained to turn with the shaft.

The shaft 58 is maintained under torsional stress. This stress tends to turn the outer guide elements 23 and 24 in respective directions corresponding to screwing of the guide elements towards each other. Accordingly, the guide elements exert pressure on the guide rollers 25 and 26. The reaction to this pressure resists the turning moment exerted on the sprockets 56 and 57 by the shaft 58. The guide rollers 25 and 26 maintain between the outer guide elements 23 and 24 a separation which is greater than the separation between the guide elements when the shaft 58 is unstressed.

With the particular arrangement illustrated in the accompanying drawings, operation of the damper to compress the main spring is accompanied by the drawing of fluid into the cylinder. When the spring subsequently extends, fluid is expelled from the cylinder at a restricted rate so that the rate of extension of the spring is controlled. It will be appreciated that the arrangement illustrated may readily be modified to provide that, upon compression of the main spring, fluid is drawn into the space outside the cylinder and when the spring subsequently extends fluid is expelled from that space through an orifice to the interior of the cylinder, the rate of flow being restricted to control the rate of extension of the spring.

I claim:

1. A damper comprising a housing, an operating member mounted for movement relative to the housing, a cylinder mounted in the housing for reciprocation relative thereto, first and second pistons in sliding contact with and movable in the cylinder in a direction parallel to the direction of reciprocation of the cylinder and drive means for transmitting motion between the operating member and the cylinder and transmitting motion between the operating member and the pistons to move both the cylinder and the pistons relative to the housing and relative to each other when the operating member is moved relative to the housing and is returned to its initial position and a third piston mounted in the housing to remain stationary with respect to the housing, wherein the cylinder is a sliding fit around the third piston, an annular plug lies in the cylinder between the first and second pistons, a piston rod extends through the annular plug from the first piston to the second piston and the piston rod is a sliding fit in the annular plug.

2. A damper according to claim 1 wherein the piston rod and the second piston are hollow and collectively define a passage for the flow of fluid between a first chamber defined in the cylinder between the first piston and the plug and a second chamber defined in the cylinder between the second piston and the third piston.

3. A damper comprising a housing, an operating member mounted for movement relative to the housing, a cylinder mounted in the housing for reciprocation relative thereto, a piston movable in the cylinder in a direction parallel to the direction of reciprocation of the cylinder, drive means for transmitting motion between the operating member and the cylinder and transmitting motion between the operating member and the piston to move both the cylinder and the piston relative to the housing and relative to each other when the operating member is moved relative to the housing and is returned to its initial position, first and second guide means adjacent to respective end portions of the cylinder for guiding the cylinder for reciprocation relative to the housing, wherein the first guide means is adjacent to the drive means and comprises a pair of outer guide elements incorporated in the housing and a pair of inner guide elements incorporated in the cylinder and lying between the outer guide elements.

4. A damper according to claim 3 wherein the guide elements of one of the pairs of inner and outer guide elements are rollers.

5. A damper according to claim 3 wherein the outer guide elements are adjustable relative to the housing.

6. A damper according to claim 3 wherein the first piston has a piston rod which extends between the inner guide elements to the drive means and the inner guide elements guide the piston rod for reciprocation relative to the cylinder.

7. A damper according to claim 3 wherein the second guide means is a sliding fit inside the cylinder.

8. A damper according to claim 3 further comprising a main spring and wherein the drive means includes a cam and follower mechanism, the cam is rotatable relative to the housing about a cam axis which is fixed with respect to the housing, the follower is trapped between the cam and a pair of transmission elements and wherein the transmission elements are mounted to occupy respective positions which are fixed with respect to the cylinder.

9. A damper according to claim 8 wherein the outer guide elements are adjustable relative to the housing.

10. A damper according to claim 8 wherein the first piston has a piston rod which extends between the inner guide elements to the drive means and the inner guide elements guide the piston rod for reciprocation relative to the cylinder.

11. A damper according to claim 8 wherein the second guide means is a sliding fit inside the cylinder.

12. A method of controlling the swinging movement of a pivoted door wherein there is used a housing containing a pair of pistons and a cylinder in which the pistons slide, there is connected with the door a rotary member supported in the housing for turning with the door relative to the housing, upon swinging of the door from a rest position, the pair of pistons and the cylinder are moved in opposite directions to draw liquid into a space defined inside the housing and, during return of the door to the rest position, the movement of both the pair of pistons and the cylinder is reversed, so expelling liquid from said space through an orifice, resistance to movement of the liquid through the orifice controlling return of the door towards the rest position.

13. A damper comprising a housing, an operating member mounted for movement relative to the housing, a cylinder mounted in the housing for reciprocation relative thereto, a piston movable in the cylinder in a direction parallel to the direction of reciprocation of the cylinder, drive means for transmitting motion between the operating member and the cylinder and transmitting motion between the operating member and the piston to move both the cylinder and the piston relative to the housing and relative to each other when the operating member is moved relative to the housing and is returned to its initial position and a main spring and wherein the drive means includes a cam and follower mechanism, the cam is rotatable relative to the housing about a cam axis which is fixed with respect to the housing, the follower is trapped between the cam and a pair of transmission elements and wherein the transmission elements are mounted to occupy respective positions which are fixed with respect to the cylinder.

14. A damper according to claim 13 wherein the cam is fixed with respect to the operating member, the follower is trapped between the transmission elements and the cam and wherein the transmission elements are spaced apart in a direction transverse to an axis of the cam and transverse to the direction of reciprocation of the cylinder.

15. A damper according to claim 14 wherein the follower is a roller and is located with respect to the cylinder only by the transmission elements and the cam.

16. A damper according to claim 14 wherein the transmission elements are rollers mounted for rotation relative to the cylinder about respective axes which are fixed with respect to the cylinder.

17. A damper according to claim 13 wherein the transmission elements are rollers mounted for rotation relative to the cylinder about respective axes which are fixed with respect to the cylinder.

18. A damper according to claim 13 wherein the follower is a roller and is located with respect to the cylinder only by the transmission elements and the cam.

* * * * *

UNITED STATES PATENT AND TRADEMARK OFFICE

CERTIFICATE OF CORRECTION

PATENT NO. : 5,291,630

DATED : March 8, 1994

INVENTOR(S) : Peter E. Brown

It is certified that error appears in the above-indentified patent and that said Letters Patent is hereby corrected as shown below:

Column 1 Line 22 after "within" insert --which--.

Column 7 Line 31 "i" should read --in--.

Signed and Sealed this

Fifth Day of July, 1994

*Attest:*

*Attesting Officer*

BRUCE LEHMAN

*Commissioner of Patents and Trademarks*